US005150848A

United States Patent [19]

Consani

[11] Patent Number: 5,150,848

[45] Date of Patent: Sep. 29, 1992

[54] RE-REELING MACHINE WORKING AT CONSTANT SPEED AND RELATED CUTTING DEVICE

[75] Inventor: Alberto Consani, Viareggio, Italy

[73] Assignee: Alberto Consani S.p.A., Borgo A. Mazzano, Italy

[21] Appl. No.: 613,679

[22] PCT Filed: Oct. 12, 1989

[86] PCT No.: PCT/IT89/00066

§ 371 Date: Feb. 4, 1991

§ 102(e) Date: Feb. 4, 1991

[87] PCT Pub. No.: WO90/04561

PCT Pub. Date: May 3, 1990

[30] Foreign Application Priority Data

Oct. 21, 1988 [IT] Italy ..... 22390 A/88

[51] Int. Cl.[5] ..... B65H 18/20; B65H 19/26

[52] U.S. Cl. ..... 242/56 R; 242/66

[58] Field of Search ..... 242/56 R, 56.6, 66

[56] References Cited

U.S. PATENT DOCUMENTS

| | | | |
|---|---|---|---|
| 2,585,226 | 2/1952 | Christman | 242/56.6 |
| 3,057,572 | 10/1962 | Rockstrom et al. | 242/66 |
| 3,505,150 | 4/1970 | Andersson | 242/56.6 |
| 3,532,573 | 10/1970 | Herman | 242/56.6 X |
| 3,720,381 | 3/1973 | Rehme et al. | 242/56 R |
| 3,997,387 | 12/1976 | Yamaguchi et al. | 242/56 R |
| 4,408,727 | 10/1983 | Dropczynski | 242/56 R |
| 4,475,696 | 10/1984 | Birch et al. | 242/66 |
| 4,496,112 | 1/1985 | Olsson et al. | 242/66 |
| 4,783,015 | 11/1988 | Shimizu | 242/66 |
| 4,828,195 | 5/1989 | Hertel et al. | 242/66 |

FOREIGN PATENT DOCUMENTS

| | | |
|---|---|---|
| 2522011 | 11/1976 | Fed. Rep. of Germany . |
| 3217628 | 3/1983 | Fed. Rep. of Germany . |
| 3640366 | 6/1988 | Fed. Rep. of Germany . |
| 2544701 | 10/1984 | France . |
| 2150536 | 7/1985 | United Kingdom . |

*Primary Examiner*—John M. Jillions

*Attorney, Agent, or Firm*—Wegner, Cantor, Mueller & Player

[57] ABSTRACT

The object of the invention is a re-reeling machine comprising a conveyor roller (11), suitable for being partially wound with a sheet material (40), a movable winding roller (13), able to be positioned by means of the rotation of a control cam (18), suitable for supporting the reel (30' and 30'' respectively) in the winding and discharge phase, and a transfer roller (23), exerting elastic pressure on the reel, suitable for bringing the reel into contact with the winding roller (13), in which re-reeling machine the replacement core (30) encounters the sheet material before reaching the axis of conjunction between the transfer roller (23) and the conveyor roller (11), and the rollers always rotate at constant speed, the conveyor roller (11) and the winding roller (13) rotating at the same peripheral speed, while the transfer roller (23) rotates at a slightly lower peripheral speed.

6 Claims, 3 Drawing Sheets

RE-REELING MACHINE WORKING AT CONSTANT SPEED AND RELATED CUTTING DEVICE

The present invention concerns a re-reeling device for sheet materials, particularly paper, and the related cutting device.

To eliminate accidental defects or imperfections in reels of sheet material, for example paper, the practice is known of repeating the winding operation on machines analogous to reeling machines, but generally of smaller dimensions, called re-reeling machines.

At present, re-reeling machines are used in which the reel being wound has no support chucks.

Re-reeling machines of this type usually comprise an upper cylinder, with a peripheral speed equal to the feeding speed of the material, and a lower cylinder, spaced from the first in such a way that a winding core for the reel to be made up can be positioned between said two cylinders. During the winding phase, the second cylinder is operated with a peripheral speed equal to that of the first cylinder, while, in the reel replacement phase, the speed of said second cylinder is reduced to allow the expulsion operations of the made up reel and the introduction of a new core. This slowing down, and in some cases even stopping, of the cylinder, results in imperfection in the first winding layers of the reel to be made up, and relatively low production.

FR-A-2 544 701 describes a reeling machine in which three winding cylinders rotate at the same constant peripheral speed, which is the advancing speed of the sheet material. The structure of said machine is complex because of the presence of continuous belts wound in annular grooves formed in one of the cylinders, which advance at a lower speed than the peripheral speed of the cylinder, and which intervene when the core is to be inserted in the space between the cylinders, in order to exert a braking action on the core itself.

The aim of the invention is to realize a re-reeling machine which allows high production by guaranteeing perfect winding of the reel right from the first layers.

In the re-reeling machine according to the invention, the winding roller is preferably moved, by means of a leverage, by a control cam, whose profile defines the length of winding of the reel. The cam profile preferably has a substantially arc of circumference portion completed by a curved line, having a minimum zone and a maximum zone. When the member driven by the cam travels along the zone descending between the arc portion and the minimum zone, the winding roller supports the wound reel, aligning with it, and a new core is introduced between the conveyor roller and the transfer roller. When the driven member reaches the minimum zone, the winding roller is in a lower position, which allows the discharge of the made up reel, while the center of the new reel, already in the winding phase, is positioned along the axis of conjunction between the conveyor roller and the transfer roller.

When the driven member reaches the maximum zone, the winding roller is in an upper position, in which it receives the reel in the winding phase, while the reel already made up leaves the winding unit. Finally, during the arc of circumference path of the driven member, the winding of the reel is completed between the three winding, conveyor and transfer rollers.

In a different embodiment, the leverage can be controlled by means of a microprocessor.

The re-reeling machine according to the invention comprises insertion arms whose ends are provided with rollers or pins, and are arranged adjacent to the core which is to be introduced, until the latter reaches the axis of conjunction between the conveyor roller and the transfer roller.

An elastic means can be used, for example a spring, a pneumatic cylinder or a cam, in order to allow the transfer roller to move away from the conveyor roller, and thus from the reel being wound, so as to avoid the wound material being crushed.

The re-reeling machine according to the invention preferably comprises a cutting device, consisting of a rotating cylinder provided with a retractable blade suitable for engaging with a recess provided on the conveyor cylinder, the emerging of the said blade being operated in such a way that the blade comes into contact with the conveyor cylinder at the end of winding.

The re-reeling machine conforming to the invention provides the advantage of perfect winding, guaranteed by the continuing constant speed of the rollers and by the absence of stress on the material from any origin.

The invention will now be explained more clearly with reference to the enclosed drawings, in which.

Figure 1:
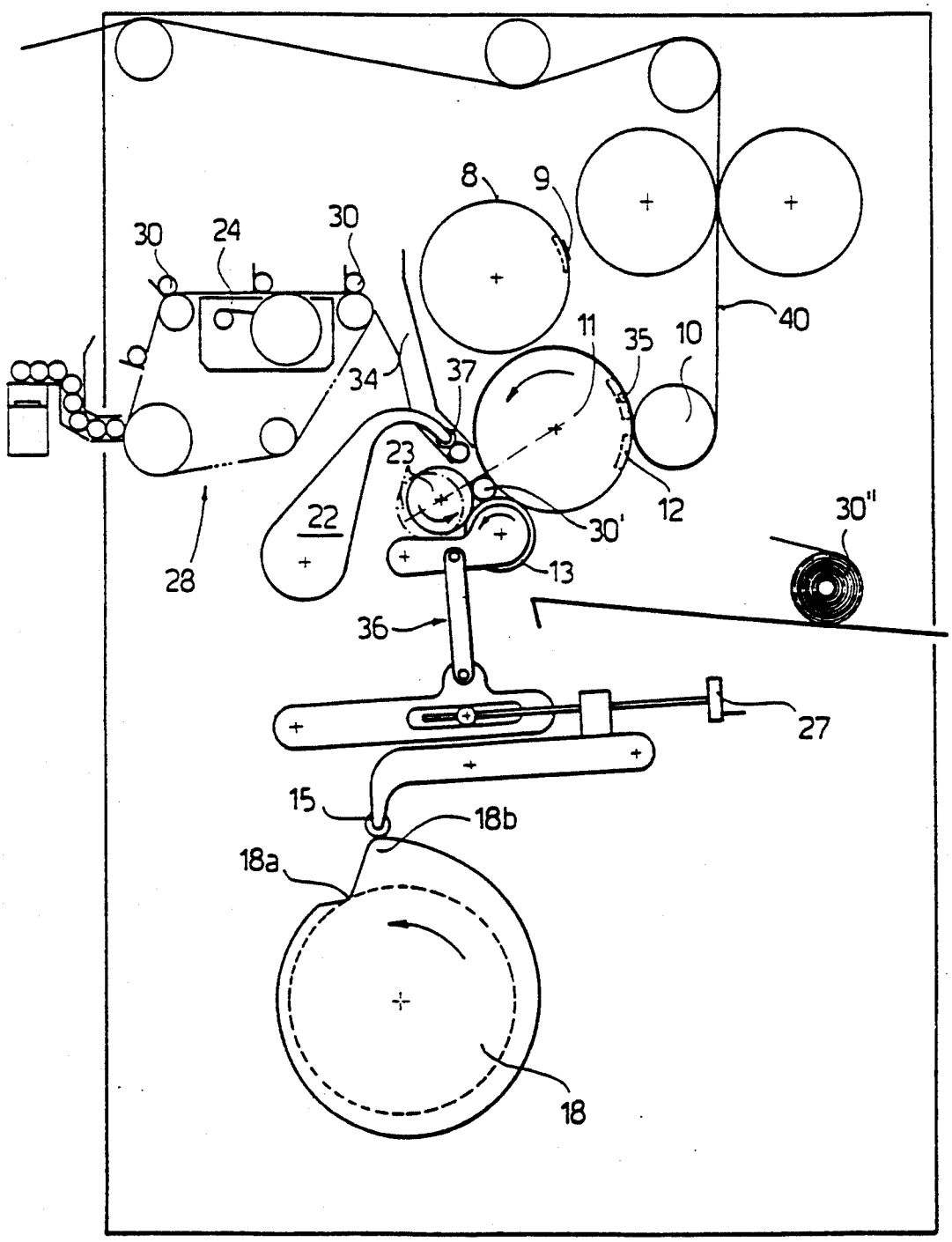
FIG. 1 shows a diagrammatic view of a part of a re-reeling machine.

In FIG. 1, a re-reeling machine is shown comprising a feeding device 28, suitable for conveying the cores 30 towards a glueing machine 24, capable of spreading certain areas of the cores 30 with adhesive as they advance towards a conveyor 34, by which the cores 30 reach a winding unit. The winding unit comprises a conveyor roller 11, partially wound with sheet material 40, for example paper, which reaches the said roller 11 after crossing a roller and counter roller unit, of which only roller 10 can be seen in the drawing. The conveyor roller 11 has an area provided with vacuum chambers 12, suitable for facilitating the engagement between the material 40 and the cylinder 11 at the moment the material 40 is cut, and a recess 35. A roller 8 is positioned adjacent to the conveyor roller 11, above the area involved by the cores arriving, provided with a retractable cutting blade 9. Below the area affected by the cores as they arrive, on the other hand, a transfer roller 23 is provided, which is affected by a movable supporting means, which allows it to shift elastically in the direction of the straight line of conjunction between its center and the center of the conveyor roller 11 (as shown with a dotted line in FIG. 1). A series of arms 22 is provided at the side of the transfer roller 23, having end pins 37 suitable for accompanying the cores 30 as they enter. On the other side, the transfer roller 23 is alongside a winding roller 13, supported in a movable way by means of a leverage 36, one of whose ends supports the winding roller 13, while the opposite end has a member 15 driven by a control cam 18. The profile of the control cam 18 has a substantially arc of circumference portion, completed by a curved line with a minimum zone 18*a* and a maximum zone 18*b*. The leverage 36 comprises a manoeuvre steering wheel suitable for regulating the distance between the winding roller 13 and the conveyor roller 11, independently of the cam 18.

Figure 2:
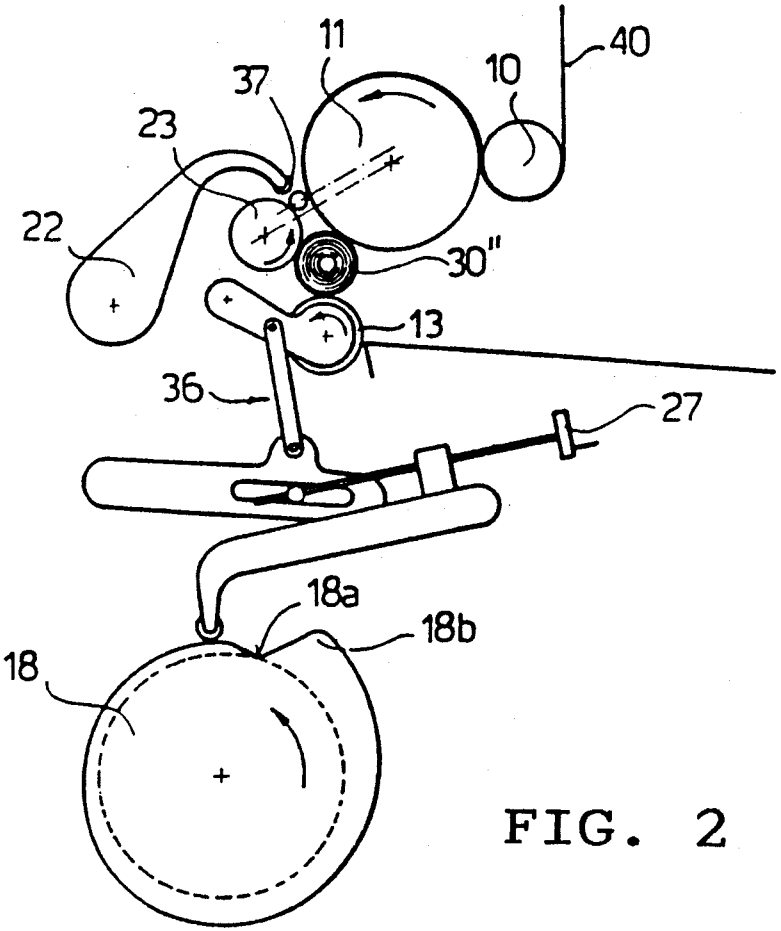
FIG. 2 shows the winding unit of the re-reeling machine in FIG. 1 in a first working phase.
Figure 5:
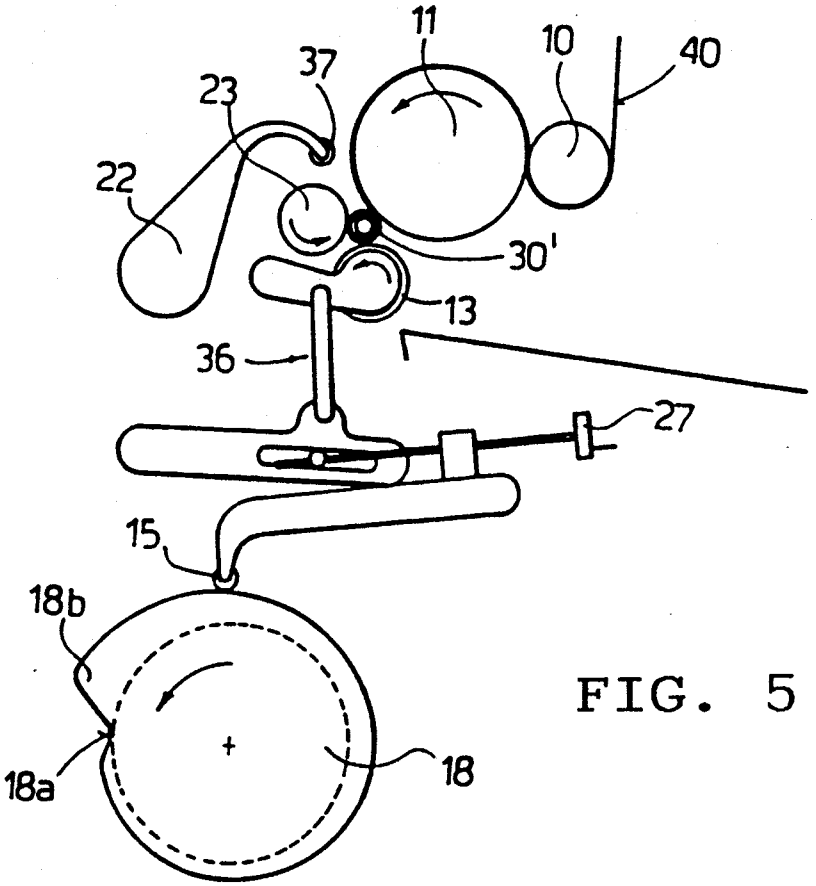
FIG. 5 shows the winding unit in FIG. 2 in a fourth working phase.

In the re-reeling machine described, the cores 30 come from a storage container not seen in the drawing, being lifted by means of the feeding device 28 up to the conveyor 34, from which they are guided between the transfer roller 23 and the conveyor roller 11. When the cores 30 reach the glueing machine 24, they are spread with adhesive in a determined area so that the first layer of material can adhere to them. The new core 30' comes into contact with the winding material 40 in the space between the transfer roller 23 and the conveyor roller 11, about 13 mm before it reaches the axis of conjunction between the said rollers (as shown in FIG. 2). At the beginning of winding, the core 30' is supported by the transfer roller 23, while the end pins 37 of the arms 22 are adjacent to it. At the same time, the reel 30'' already wound is once more in the space between the conveyor roller 11 and the winding roller 13, in alignment with the latter. In this phase, the member 15 driven by the cam 18 travels along the section on the cam profile descending between the arc of circumference and the minimum zone 18*a*.

Figure 3:
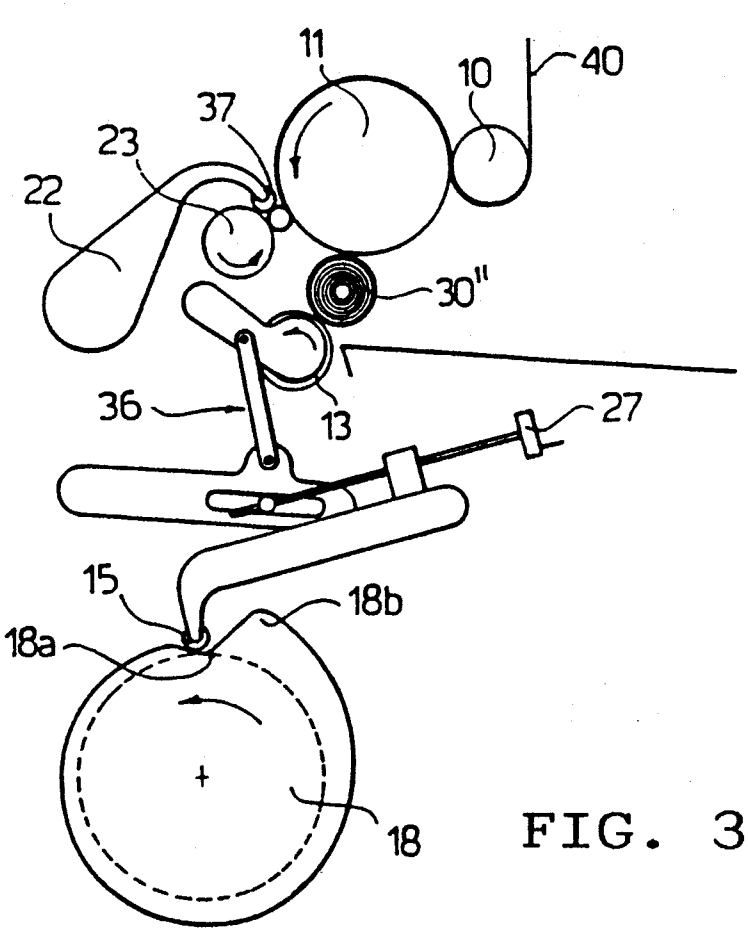
FIG. 3 shows the winding unit in FIG. 2 in a second working phase.

When the driven member 15 reaches the minimum zone 18*a* (FIG. 3), the winding roller 13 is in a lower position, in which it allows the reel 30'' already wound to be discharged, while the reel which is being formed 30' is still supported by the transfer roller 23, which has moved elastically further away from the conveyor roller 11, so as not to crush the wound material.

Figure 4:
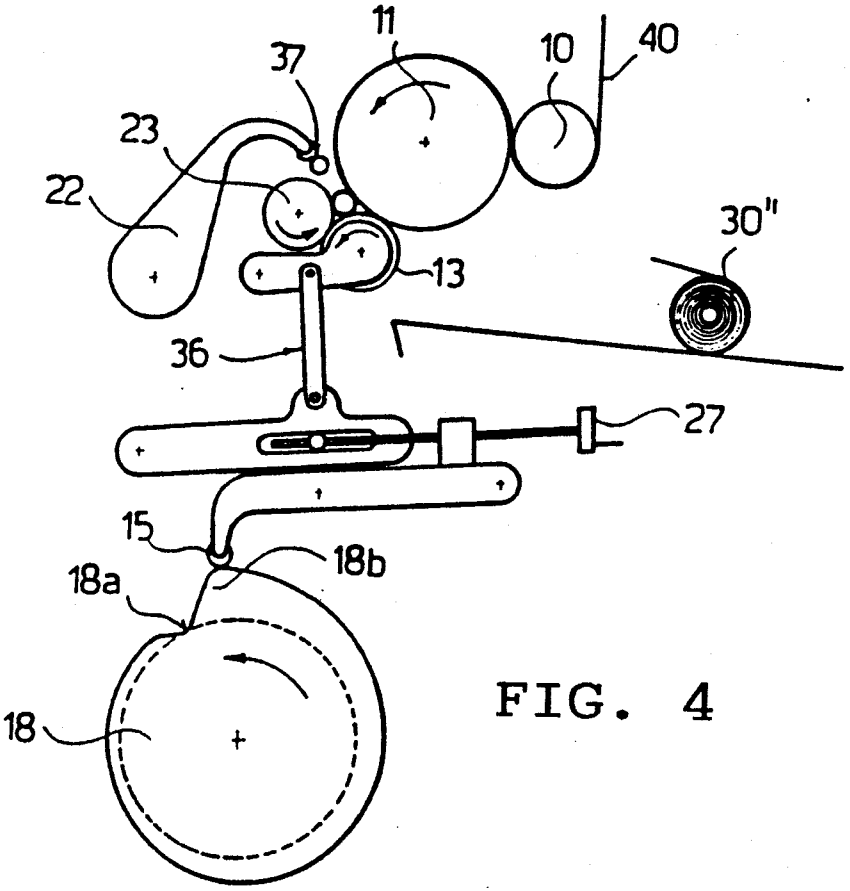
FIG. 4 shows the winding unit in FIG. 2 in a third working phase.

When the driven member 15 reaches the maximum zone 18*b* (FIG. 4), the winding roller 13 reaches an upper position, in which it receives the reel 30' being wound. In this phase, the end pins 37 of the arms 22 no longer affect the reel being made up.

When the driven member 15 travels along the arc of circumference portion of the cam 18 (FIG. 4), the reel 30' continues to be wound, which is between the three conveyor 11; transfer 23 and winding 13 rollers.

In the re-reeling machine described, all the rollers rotate at constant speed in the rotation direction shown by the arrows, without reducing their speed even during replacement of the made up roller with the new core. The conveyor roller 11 and the winding roller 13 rotate at the same peripheral speed, while the transfer roller 23 rotates at a slightly lower peripheral speed (for example of about 1%.

As each revolution of the cam 18 is completed, which corresponds to one complete winding of the reel, the emerging of the retractable blade 9 of the roller 8 is operated in such a way that it can engage with the recess 35 of the conveyor roller 11, separating the sheet material and so preparing a new end of winding material.

Obviously the rotation of the roller 11 is in phase with the rotation of the roller 8, so that the recess 35 meets the blade 9 when the reel reaches the predetermined winding diameter.

The steering wheel 27, by means of which the winding roller 13 can be moved away from or near to the conveyor roller 11, is provided to guarantee that the winding roller 13 carries out its function without crushing the made up reel 30', for any predetermined size of reel.

I claim:

1. A re-reeling machine for re-reeling sheet material on a core comprising:

a plurality of rollers suitable for making a sheet material advance at a constant speed;

said plurality of rollers including a conveyor roller on which said sheet material is partially wound, a winding roller, said winding roller being movable to accommodate the increasing diameter of the core as the sheet material is wound thereon, and a transfer roller which cooperates with said conveyor roller and said winding roller during the winding of the core, said transfer roller being disposed upstream of said winding roller and displaceable with respect to said conveyor roller to allow insertion of the core in a space formed between said rollers; and means for inserting successive cores in the space formed between said rollers;

wherein said conveyor roller and said winding roller rotate at a first constant peripheral speed equal to an advancing speed of the sheet material, and said transfer roller rotates at a second constant peripheral speed which is lower than said first constant peripheral speed so as to facilitate introduction of a successive core in the space formed between said rollers.

2. A re-reeling machine as in claim 1, wherein each successive core encounters the sheet material about 13 mm before reaching an axis of conjunction between the transfer roller and the conveyor roller.

3. A re-reeling machine as in claim 1, wherein said second speed is about 1% lower than said first speed.

4. A re-reeling machine as in claim 1, wherein the winding roller is moved using leverage by a control cam having a profile with a substantially arc of circumference portion completed by a curved line, having a maximum zone and a minimum zone, said profile defining the length of the winding.

5. A re-reeling machine as in claim 1, further comprising insertion arms having ends provide with pins, said ends being positioned adjacent to the successive core to be introduced, until said successive core reaches an axis of conjunction between said conveyor roller and said transfer roller.

6. A re-reeling machine as in claim 1, further comprising a cutting device including a rotating roller provided with a retractable blade, said rotating roller being adapted to engage a recess provided in said conveyor roller so that said blade comes into contact with the conveyor roller upon completion of winding.

* * * * *